United States Patent [19]

Destree et al.

[11] Patent Number: 4,640,648

[45] Date of Patent: Feb. 3, 1987

[54] INDUSTRIAL FLOOR AND CONSTRUCTION METHOD

[75] Inventors: Xavier P. Destree; Angelo A. Lazzari, both of Brussels, Belgium

[73] Assignee: Eurosteel S.A., Brussells, Belgium

[21] Appl. No.: 678,552

[22] PCT Filed: Mar. 7, 1984

[86] PCT No.: PCT/BE84/00006

§ 371 Date: Nov. 2, 1984

§ 102(e) Date: Nov. 2, 1984

[87] PCT Pub. No.: WO84/03530

PCT Pub. Date: Sep. 13, 1984

[30] Foreign Application Priority Data

Mar. 10, 1983 [BE] Belgium ..... 0/210291

[51] Int. Cl.[4] ..... E02D 27/08; E02D 27/26; E04B 5/32

[52] U.S. Cl. ..... 405/229; 52/742

[58] Field of Search ..... 405/229, 258, 266, 271; 52/169.1, 741, 742, 743; 264/31

[56] References Cited

U.S. PATENT DOCUMENTS 2,078,289 4/1937 Sloan .

3,561,175 2/1971 Best et al. ..... 405/229 X

FOREIGN PATENT DOCUMENTS 815429 9/1974 Belgium .
839980 7/1976 Belgium .
2754218 6/1979 Fed. Rep. of Germany .
662327 8/1929 France .
7239964 6/1973 France .
1171490 11/1969 United Kingdom .

OTHER PUBLICATIONS

Bouwwereld–C. Misset N.V. Doetinchem (The Netherlands), vol. 73, No. 10, May 13, 1977, pp. 38–41.

W. H. Taylor: "Concrete Technology and Practice", American Elsevier, New York, 1965, pp. 426–429.

*Primary Examiner*—David H. Corbin

*Attorney, Agent, or Firm*—Zarley, McKee, Thomte, Voorhees & Sease

[57] ABSTRACT

To make a continuous fiber-reinforced concrete slab, a totally free and independent slab is cast by using limited shrinkage concrete. After having carefully prepared a course, a separation sheet is layed thereon and a compressible mattress is intercalated between the concrete and the constructions or construction parts susceptible of limiting or traversing the slab.

7 Claims, No Drawings

INDUSTRIAL FLOOR AND CONSTRUCTION METHOD

Most of the industrial floors (manufacture workshop floors, warehouse floors, garage floors, . . . ) are made of reinforced, surface-polished concrete.

These floors are made by spreading freshly prepared concrete onto a sheet of plastic material placed on the compacted foundation course, the reinforcement being placed either before or while the concrete is being placed.

The reinforcement also may be made up by adding steel fibers to the concrete during the mixing stage; in that way the concrete becomes homogeneous due to the fact that it is reinforced in all directions and that the fibers-concrete interface has a much greater surface area than in case of a conventional reinforcement.

The plastics sheet is placed on the compacted foundation course in order to reduce the friction coefficient of the slab on the ground and thus reduce the tensions due to shrinkage of the concrete.

The concrete-casting operation is followed with a surface-polishing stage which after termination provides the concrete with a mirror polish aspect, as known. The concrete then needs to be protected from too fast desiccation by means of a protective coating (improperly termed "curing") layer applied on the concrete immediately thereafter, with the purpose of retaining for the longest possible time all water which is not needed for chemical effects, in an effort to prevent savage crack-formations.

After the first hardening stage, the ultimate step involves creating in the slab startings of shrinkage cracks.

As a matter of fact, slabs of the kind described may be very large with surface areas of 5000 $m^2$ or more and for that reason in many points of the slab, concrete shrinkage tensions will exceed the tensile strength of the concrete and result in the appearance of cracks.

In order to avoid these savage crack formations, it is of common use to provide saw cuts along rectangular meshes of 25 to 35 $m^2$ surface to provide crack startings. The slab completed in that way shows discontinuities each of which is made of a saw-cut seam causing drawbacks such as breaking of the seams on use by passage of handling trucks, retentions of dirt and dust.

An important improvement of the floor or slab quality could be obtained by suppressing the shrinkage seams without however causing any crack formation.

According to the prior art, the industrial continuous concrete floor was prepared by spreading concrete onto a previously placed reinforcement armouring system.

The reinforcement generally used in that case consists of two planes of fine wire nettings assembled into cloths. Each of these planes of reinforcement must be as close as possible by the surfaces which define the volume of the industrial floor concrete body.

This causes difficulties in operation:

- to maintain a constant distance between the two planes of reinforcement using systems called distance pieces
- to maintain the reinforcement of the surface as close as possible by said surface to be reinforced while constantly maintaining a minimum layer of concrete to cover the steel.

The difficulties encountered in positioning mainly result from the fact that the finished level of the industrial floor is strictly determined while the level of the foundation course supporting the reinforcement system is variable.

The purpose of the invention is to make an industrial floor of quality in continuous concrete having a surface area which may reach or exceed 5000 $m^2$ and the thickness of which is identical with that of a conventional slab the concrete being provided with a homogeneous multidirectional reinforcement system obtained by mixing a minimum of fibers, for example steel fibers, to the concrete in the mixing stage.

For that purpose there is cast a totally free and independent slab by using a limited shrinkage concrete.

The fiber reinforcement system enables to limit the development of cracks.

The action of such reinforcement is more durable when using fibers which are provided with anchorage means for anchoring them to the concrete and more particularly fibers of a diameter between 0.5 and 1 mm for a length respectively between 40 and 60 mm. These fibers may be provided with anchorage corrugations or ondulations spread over their length and/or may have anchorage hooks or heads or bulges at both ends of the fiber and they may be made up of steel wire having a tensile strength greater than 100 $kg/mm^2$ in an amount between 25 and 30 $kg/m^3$.

Restriction of crack formation to the field of crack formation at microscopic scale by means of reinforcement fibers is however not guaranteed in the process of time for surfaces of great area, for example greater than 1000 $m^2$.

It is therefore absolutely necessary to effect a maximum reduction of the total concrete shrinkage, composed of thermal and hygrometric shrinkages.

For that purpose the content of cement and the content of water in the concrete will be reduced; moreover there will be used a normal artificial type of Portland cement having better capacities to retain water in the concrete of the slab.

Finally, in order to reduce the tension stresses caused by a given shrinkage, it is strictly necessary for the slab to be in a condition of total independency with respect to the ground on which it is placed, the boundary building parts or buildings such as walls or doors, the traversing building parts or buildings such as columns, caps, sewage inspection room covers and drains. In any way, this independency only can be ensured for slabs having a substantially square or circular or possibly rectangular plane the greater side of which does not exceed the smaller side by more than 50%.

Said independency is obtained practically by imposing several preventive measures:

- constantly compacting the foundation course over its whole surface, thus providing a k-value of Westergaard of at least 5 $kg/cm^3$;
- taking care that the tolerances in levelling of the foundation course do not exceed $\pm 1$ cm with respect to the reference level;
- placing a plastic sheet on the foundation course before casting the concrete;
- strictly separating the concrete slab body from boundaries or traversing building parts or buildings by placing a (1 cm thick) mattress of compressible plastic material which upon crushing will allow the slab to undergo shrinkage at places near stationary points of said slab-restricting boundaries or traversing building parts or buildings;
- placing complementary reinforcements around said stationary points, perpendicularly to the directions of possible crack-propagations; these reinforcements of 8 mm diameter, 1 m minimum length are placed so that a length will be left for anchoring on both sides of the crack, if any;

taking care that in use the charges will not exceed 3000 kg/m$^2$ and that the slab will not be put into service until after six weeks following concrete casting.

Example of slab which the process enables to build in a totally continuous way, independently of any seam.

Rectangular plane of 50×60 m$^2$.

Foundation course: 25 cm of compacted and vibrated sand, giving a constant modulus of reaction k of 6 kg/cm$^3$.

Placing of a polyethylene sheet of 0.1 mm thickness over the entire area of the surface to be covered with concrete.

Placing of a compressible mattress (for example of bakelized glass wool) of 1 cm thickness between the slab and the buildings or building parts restricting the slab or traversing it.

Thickness of the floor: 15 cm.

Specification relating to the concrete as used:

cement: slowly setting Portland: 310 kg water: total water content: 155 l i.e. water/cement ratio=0.5 addition: superfluidifying sulfonated melamine in amount of 3.5 l/m$^3$ concrete particles size:

0–16 mm: 1,550 kg

16–25 mm: 390 kg steel fibers: diameter 1 mm, length 60 mm provided with anchoring corrugations as described in Belgian Pat. No. 895,522 dated Dec. 30, 1982; in concentration of 30 kg/m$^3$.

casting of the concrete: conventional process without formwork load of the slab in use: 2,500 kg/m$^2$.

It should be understood that the invention is not restricted to the details described hereabove and that many modifications may be made thereto without going out of the scope of the invention.

We claim:

1. A process for making a totally independent and continuous slab of fiber-reinforced concrete devoid of seams, which comprises the steps of:

providing a foundation course;

compacting said foundation course to a k value of Westergaard of at least 5 kg/cm$^3$;

leveling said foundation course with a tolerance of at most ±1 cm with respect to a reference level;

placing a plastic sheet on said foundation course;

placing a compressible mattress adjacent fixed boundaries which are to limit or traverse said slab so as to separate said slab from said fixed boundaries;

placing complementary reinforcements adjacent said fixed boundaries;

casting on said foundation course, adjacent said fixed boundaries, a limited shrinkage concrete reinforced with fibers;

allowing said concrete to set.

2. A process as claimed in claim 1, in which said concrete contains reinforcing fibers in a proportion comprised between 25 and 30 kg/m$^3$.

3. A process as claimed in claim 1, in which said concrete contains reinforcing steel fibers in a proportion comprised between 25 and 30 kg/m$^3$, said fibers having a diameter between 0.5 and 1 mm, a length between 40 and 60 mm and anchoring means selected from the group consisting of ondulations, corrugations, hooks and bulges.

4. A process as claimed in claim 1, wherein the shrinking of said concrete is limited by reducing its content of cement and water.

5. A process as claimed in claim 4 wherein a Portland type of cement is used in said concrete.

6. A process as claimed in claim 1, wherein the slab is not to be subjected to charges exceeding 3000 kg/m$^2$.

7. A process as claimed in claim 1 wherein said setting of said concrete is allowed for at least six weeks.

* * * * *